US010930459B2

(12) United States Patent
Li et al.

(10) Patent No.: US 10,930,459 B2
(45) Date of Patent: Feb. 23, 2021

(54) ELECTROMAGNETIC RELAY

(71) Applicant: FUJITSU COMPONENT LIMITED, Tokyo (JP)

(72) Inventors: Ying Li, Tokyo (JP); Masahiro Kaneko, Tokyo (JP); Nobuo Yatsu, Tokyo (JP); Kohei Takahashi, Tokyo (JP); Katsuaki Koshimura, Tokyo (JP); Miki Kitahara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 163 days.

(21) Appl. No.: 16/143,955

(22) Filed: Sep. 27, 2018

(65) Prior Publication Data

US 2019/0103240 A1 Apr. 4, 2019

(30) Foreign Application Priority Data

Oct. 2, 2017 (JP) ..... JP2017-192336

(51) Int. Cl.

| | |
|---|---|
| ***H01H 50/54*** | (2006.01) |
| ***H01H 50/04*** | (2006.01) |
| ***H01H 45/02*** | (2006.01) |
| ***H01H 51/01*** | (2006.01) |
| ***H01H 50/56*** | (2006.01) |
| ***H01H 50/18*** | (2006.01) |
| ***H01H 1/60*** | (2006.01) |
| ***H01H 50/02*** | (2006.01) |

(52) U.S. Cl.

CPC ..... *H01H 50/045* (2013.01); *H01H 1/60* (2013.01); *H01H 45/02* (2013.01); *H01H 50/023* (2013.01); *H01H 50/18* (2013.01); *H01H 50/56* (2013.01); *H01H 51/01* (2013.01)

(58) Field of Classification Search

CPC .. H01H 50/02; H01H 50/04; H01H 50/05045; H01H 50/18; H01H 50/56; H01H 45/02; H01H 51/01

USPC ..... 335/2

See application file for complete search history.

(56) References Cited

U.S. PATENT DOCUMENTS 3,086,141 A * 4/1963 Rubenstein ..... H05B 41/12 315/100
3,216,251 A * 11/1965 Hansen ..... G03B 27/735 73/223

(Continued)

FOREIGN PATENT DOCUMENTS

| | | |
|---|---|---|
| CN | 103531263 | 1/2014 |
| CN | 106716587 | 5/2017 |
| JP | H03-098230 | 4/1991 |

*Primary Examiner* — Shawki S Ismail
*Assistant Examiner* — Lisa N Homza
(74) *Attorney, Agent, or Firm* — IPUSA, PLLC

(57) ABSTRACT

An electromagnetic relay includes a fixed contact part, a movable contact part, an armature, an electromagnet, and a base. The fixed contact part includes a fixed contact. The movable contact part includes a movable contact that faces the fixed contact. The armature is formed of a magnetic material and configured to bring the movable contact into or out of contact with the fixed contact. The electromagnet is configured to generate a magnetic field to move the armature. The base holds the fixed contact part, the movable contact part, and the electromagnet. The electromagnetic relay further includes multiple electrodes configured to generate an electric field between the electrodes.

8 Claims, 17 Drawing Sheets

(56) References Cited

U.S. PATENT DOCUMENTS

| | | | | |
|---|---|---|---|---|
| 2001/0033213 | A1* | 10/2001 | Swartzentruber ..... | H01H 51/01<br>335/78 |
| 2017/0162353 | A1 | 6/2017 | Kubono | |
| 2019/0103240 | A1* | 4/2019 | Li ..... | H01H 50/56 |

* cited by examiner

ELECTROMAGNETIC RELAY

CROSS-REFERENCE TO RELATED APPLICATION

The present application is based on and claims priority to Japanese patent application No. 2017-192336, filed on Oct. 2, 2017, the entire contents of which are incorporated herein by reference.

BACKGROUND OF THE INVENTION

1. Field of the Invention

The present invention relates to electromagnetic relays (hereinafter referred to as "relays").

2. Description of the Related Art

Relays are electronic components for controlling the on-off of electric power or the like. The relay includes, for example, a fixed contact, a movable contact, an armature, and an electromagnet. When the electromagnet produces a magnetic field, the armature is attracted to the electromagnet, and the movable contact moves to contact the fixed contact to turn on the relay. When the magnetic field disappears, the armature moves away from the electromagnet by the restoring force of a spring, and the movable contact is separated from the fixed contact to turn off the relay.

In the relay, the adhesion of a foreign substance to the surface of the movable contact or the fixed contact may result in contact failure. The foreign substance, which originates from the organic-compound cover or base of the relay, is generated by, for example, the repeated on-off operations of the relay.

Japanese Laid-open Patent Publication No. 3-098230 illustrates a relay that includes a twin movable contact spring, a fixed contact, and a stud. Two movable contacts are provided at an end of the spring. The fixed contact includes a V-shaped protrusion or depression. When the stud is driven, each movable contact contacts the V-shaped slope. This configuration is intended to increase the amount of sliding of the contacts to control the adhesion and accumulation of a foreign substance to improve the reliability of the contacts.

SUMMARY OF THE INVENTION

According to an aspect of the present invention, an electromagnetic relay includes a fixed contact part, a movable contact part, an armature, an electromagnet, and a base. The fixed contact part includes a fixed contact. The movable contact part includes a movable contact that faces the fixed contact. The armature is formed of a magnetic material and configured to bring the movable contact into or out of contact with the fixed contact. The electromagnet is configured to generate a magnetic field to move the armature. The base holds the fixed contact part, the movable contact part, and the electromagnet. The electromagnetic relay further includes multiple electrodes configured to generate an electric field between the electrodes.

DESCRIPTION OF THE EMBODIMENTS

Figure 1A:
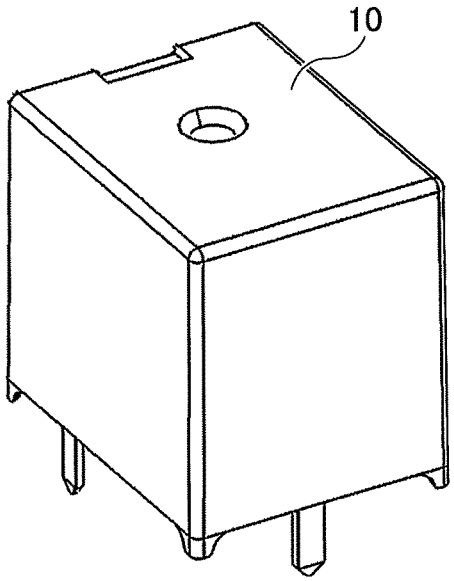
FIG. 1A is a perspective view of a relay.

A relay according to an aspect of the present invention can more reliably control the adhesion of a foreign substance to contacts to reduce the possibility of contact failure.

Embodiments of the present invention are described below with reference to the accompanying drawings. The same elements are referred to using the same reference numeral, and duplicate description thereof may be omitted.

Figure 1B:
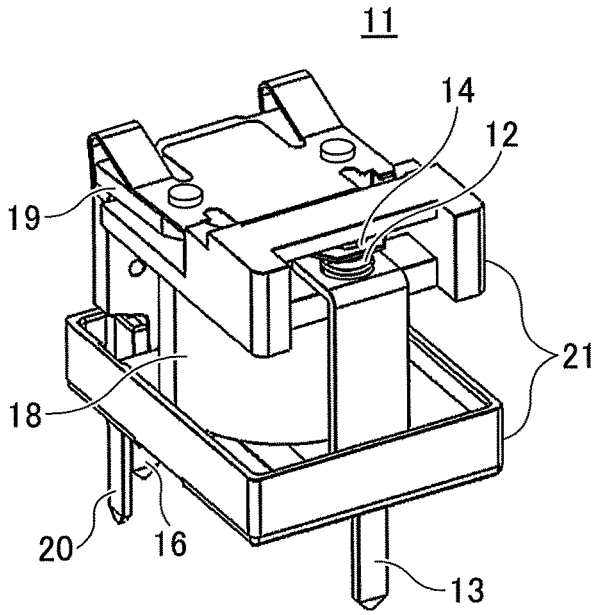
FIG. 1B is a perspective view of a body of the relay.
Figure 1C:
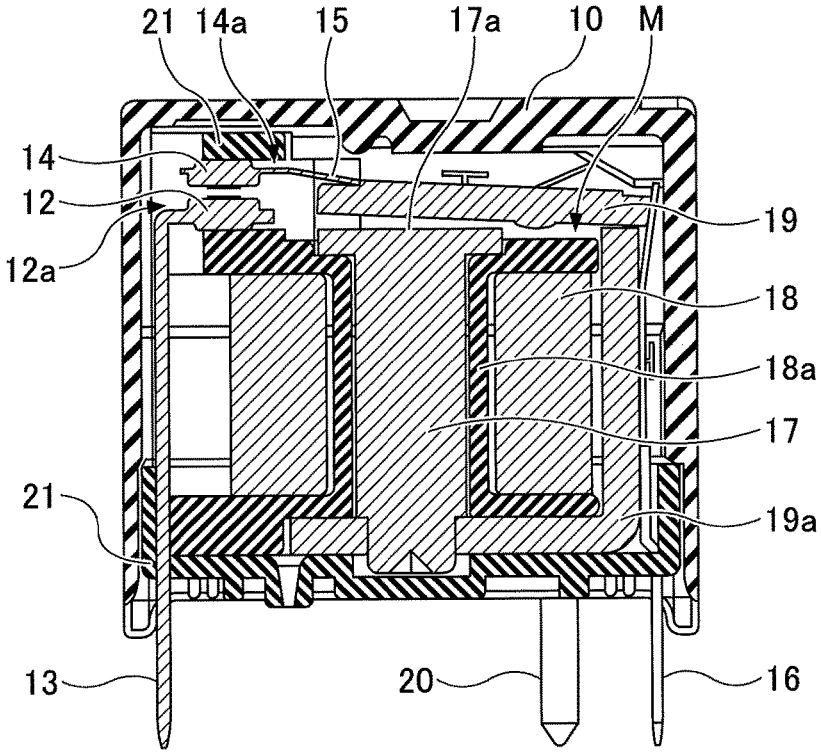
FIG. 1C is a schematic sectional view of the relay.

A relay is described with reference to FIGS. 1A through 1C. FIG. 1A is a perspective view of a relay. FIG. 1B is a perspective view of a body of the relay. FIG. 1C is a schematic sectional view of the relay.

The relay includes a box-shaped cover 10 and a body 11 accommodated in the cover 10. The cover 10 is formed of an insulating material and is open on one side. The body 11 includes a fixed contact part 12*a* and a movable contact part 14*a*. The fixed contact part 12*a* includes a fixed terminal 13 and a fixed contact 12. The movable contact part 14*a* includes a movable spring 15, a movable contact 14, and a movable terminal 16. The body 11 further includes an electromagnet M, an armature 19 formed of a magnetic material, and a base 21 formed of an insulating material. The armature 19 is moved by a magnetic field produced by the electromagnet M to move the movable contact part 14*a* to bring the movable contact 14 into contact with the fixed contact 12. The fixed contact part 12*a* and the movable contact part 14*a*, together with the armature 19 and the electromagnet M, are held on the base 21.

The electromagnet M includes a cylindrical iron core 17, a bobbin 18*a* surrounding the iron core 17, and a coil 18 wound on the bobbin 18*a*. Coil terminals 20 are attached one to each end of the coil 18. An upper surface 17*a* and a lower surface of the electromagnet M define the poles of the electromagnet M.

The body 11 further includes an L-shaped yoke 19*a* provided outside the coil 18. The armature 19 is connected to the yoke 19*a*. The armature 19 is pivotable with the armature 19 near its part connecting to the yoke 19*a* serving as a pivot. A hinge spring is attached to the armature 19 and the yoke 19*a* to urge the armature 19 in a direction away from the surface 17*a*. The cover 10 surrounds the body 11 with the coil terminals 20, the fixed terminal 13, and the movable terminal 16 being exposed outside. The body 11 is sealed within the cover 10 by an insulating resin.

Next, an operation of the relay is described. With no electric current flowing through the coil 18, the armature 19 is urged away from the surface 17*a* by the hinge spring. In this state, the armature 19 contacts the movable spring 15 to press the movable spring 15 in a direction away from the electromagnet M. Thus, the movable contact 14 is out of contact with the fixed contact 12.

When an electric current flows to the coil 18 via the coil terminals 20, the electromagnet M produces a magnetic field, so that the armature 19 is attracted to the surface 17*a*. At this time, the armature 19 is out of contact with the movable spring 15, and the movable spring 15 is urged toward the electromagnet M by its restoring force, so that the movable contact 14 contacts the fixed contact 12. Thus, the fixed terminal 13 and the movable terminal 16 are electrically connected.

When the electric current flowing to the coil 18 is stopped, the magnetic field disappears, so that a force to attract the armature 19 to the surface 17*a* is lost. By the restoring force of the hinge spring, the armature 19 moves away from the surface 17*a*, so that the armature 19 contacts the movable spring 15 to press the movable spring 15 away from the electromagnet M. As a result, the movable contact 14 is out of contact with the fixed contact 12.

By repeatedly turning on and off the relay, a foreign substance originating from the cover 10 or the base 21 may be generated. The adhesion of the foreign substance to the movable contact 14 or the fixed contact 12 may cause contact failure. The foreign substance adheres to the movable contact 14 or the fixed contact 12 because the charged foreign substance is attracted to the movable contact 14 or the fixed contact 12 by an electrostatic attraction force due to an electric field generated between the movable contact 14 and the fixed contact 12.

Relays according to the following embodiments include collecting electrodes that generate an electric field. With the electric field generated by the collecting electrodes, it is possible to attract and collect a foreign substance to the collecting electrodes to hinder the foreign substance from approaching the fixed contact 12 and the movable contact 14, thereby controlling the adhesion of the foreign substance to the fixed contact 12 and the movable contact 14 to reduce the possibility of contact failure. The following description is focused on the collecting electrodes and associated structures.

First Embodiment

Figure 2A:
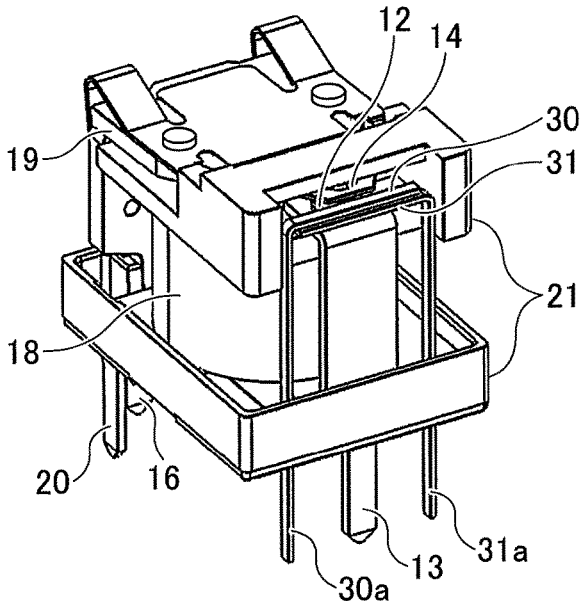
FIG. 2A is a perspective view of a body of a relay according to a first embodiment.
Figure 2B:
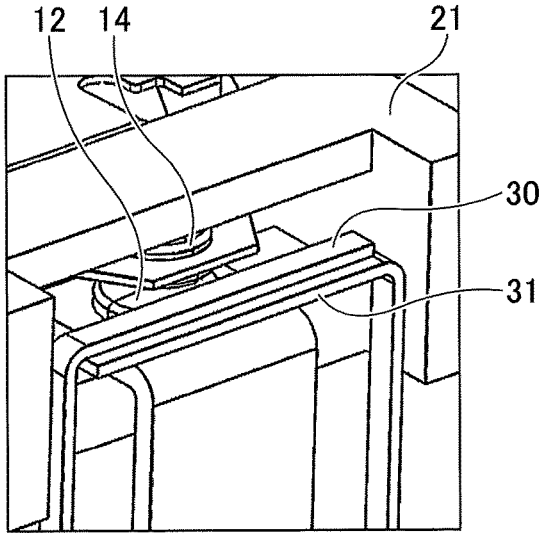
FIG. 2B is an enlarged perspective view of the body according to the first embodiment.
Figure 2C:
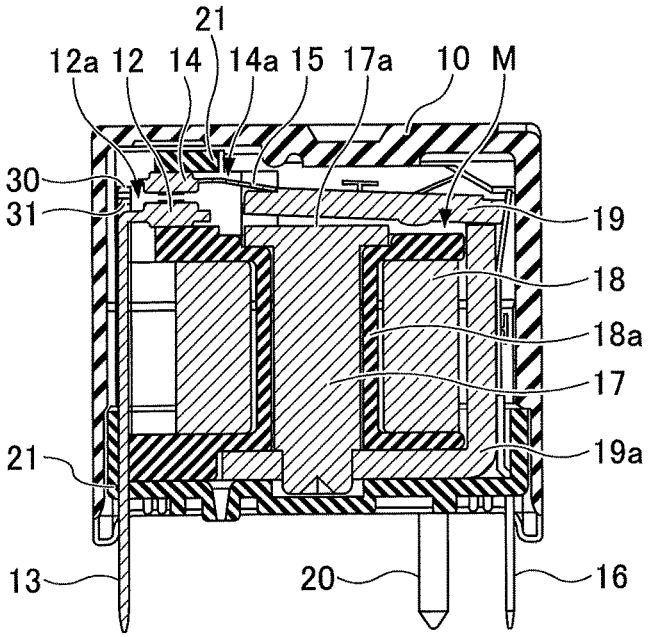
FIG. 2C is a schematic sectional view of the relay according to the first embodiment.
Figure 2D:
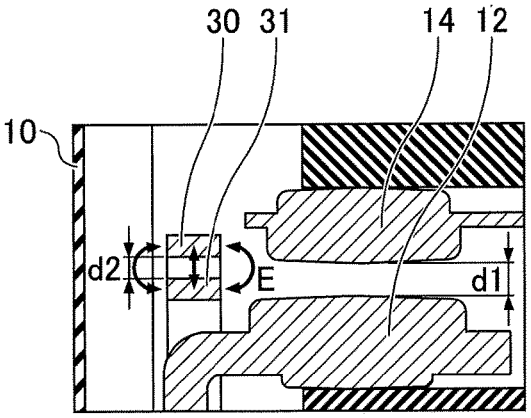
FIG. 2D is an enlarged sectional view of the relay according to the first embodiment.

A relay according to a first embodiment is described with reference to FIGS. 2A through 2D. FIG. 2A is a perspective view of the relay. FIG. 2B is an enlarged perspective view of the relay. FIG. 2C is a schematic sectional view of the relay. FIG. 2D is an enlarged sectional view of the relay.

The relay includes a pair of collecting electrodes 30 and 31 provided to face each other near the fixed contact 12 and the movable contact 14. The collecting electrodes 30 and 31 each have a flat plate shape, and are placed parallel to each other at a certain interval to avoid contacting each other. The distance between the two collecting electrodes 30 and 31 is uniform. Terminals 30*a* and 31*a* are connected to the collecting electrodes 30 and 31, respectively. The terminals 30*a* and 31*a* extend from the collecting electrodes 30 and 31, respectively, to protrude from the base 21. Thus, the terminals 30*a* and 31*a* are exposed outside the package the same as the fixed terminal 13 and the movable terminal 16.

The terminals 30*a* and 31*a* are held on the base 21 such that the fixed contact part 12*a* and the movable contact part 14*a* are spaced apart and insulated from the collecting electrodes 30 and 31 and that the collecting electrodes 30 and 31 are spaced apart and insulated from each other.

When voltage is applied to the terminals 30*a* and 31*a*, an electric field E is generated between the collecting electrodes 30 and 31. A charged foreign substance is attracted to the collecting electrode 30 by the electric field E. Therefore, a foreign substance's approaching the fixed contact 12 and the movable contact 14 is controlled, and the adhesion of the foreign substance to the fixed contact 12 and the movable contact 14 is controlled. As a result, it is possible to reduce the contact failure. By adjusting the distance between the collecting electrodes 30 and 31 and the voltage applied to the collecting electrodes 30 and 31, an electric field greater than an electric field generated between the fixed contact 12 and the movable contact 14 can be generated between the collecting electrodes 30 and 31.

For example, it is assumed that a rated voltage V1 of the relay is 14V and a voltage V2 applied to the collecting electrodes 30 and 31 is 100V. Furthermore, it is assumed that a distance d1 between the fixed contact 12 and the movable contact 14 and a distance d2 between the collecting electrodes 30 and 31 are 0.3 mm and 0.25 mm, respectively. In this case, an electric field E1 generated between the fixed contact 12 and the movable contact 14 is 46666.7 V/m (E1=V1/d1=14V/0.3 mm), and an electric field E2 generated between the collecting electrodes 30 and 31 is 400000 V/m (E2=V2/d2=100V/0.25 mm). Accordingly, an electric field approximately nine times the electric field between the fixed contact 12 and the movable contact 14 can be generated between the collecting electrodes 30 and 31. As a result, it is possible to improve the effect of attracting and collecting a charged foreign substance to control the foreign substance's approaching the fixed contact 12 and the movable contact 14.

While the collecting electrodes 30 and 31 face each other near the fixed contact 12 and the movable contact 14, the collecting electrodes 30 and 31 can attract and collect a foreign substance in whichever region inside the cover 10 the collecting electrodes 30 and 31 are provided. When the collecting electrodes 30 and 31 are provided near the fixed contact 12 and the movable contact 14 as in this embodiment, it is possible to improve the effect of controlling a foreign substance's approaching a space between the fixed contact 12 and the movable contact 14 with respect to foreign substances around the fixed contact 12 and the movable contact 14.

In other respects than those described above, the relay of the first embodiment may be the same as the relay illustrated in FIGS. 1A through 1C.

Second Embodiment

Figure 3A:
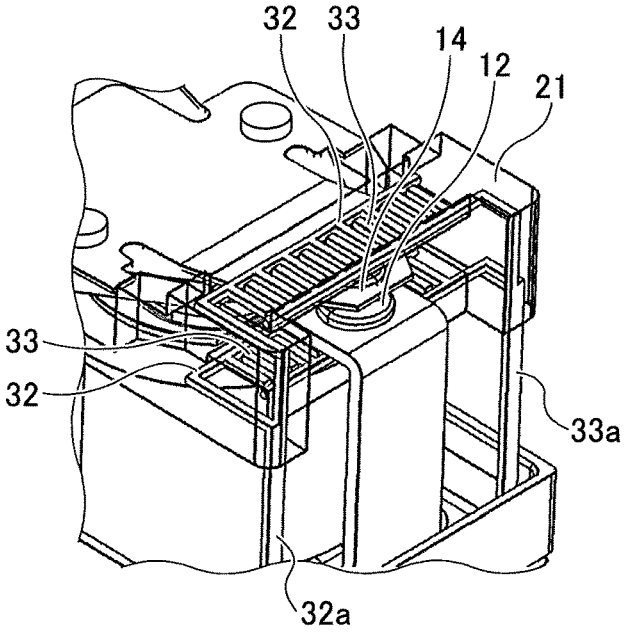
FIG. 3A is an enlarged perspective view of a body of a relay according to a second embodiment.
Figure 3B:
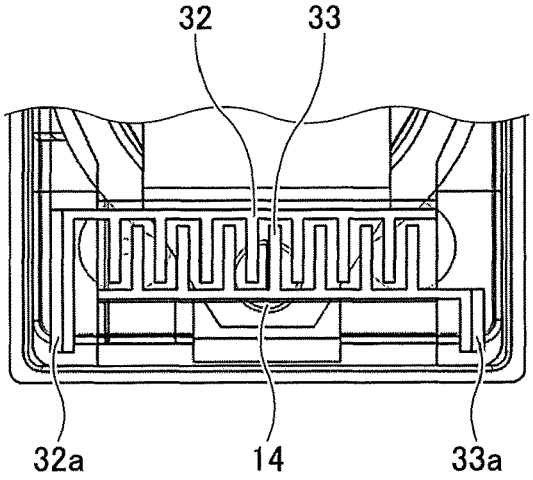
FIG. 3B is an enlarged plan view of the body according to the second embodiment.
Figure 3C:
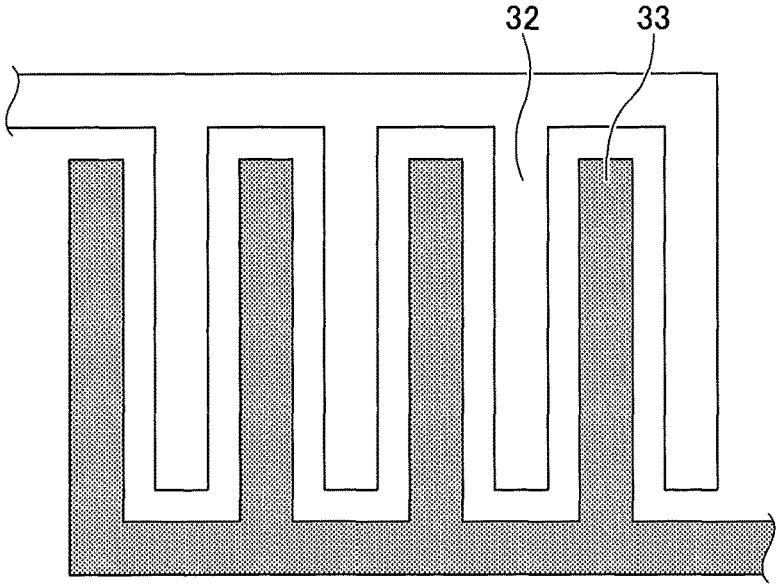
FIGS. 3C and 3D are a plan view and a sectional view, respectively, of collecting electrodes according to the second embodiment.
Figure 3D:
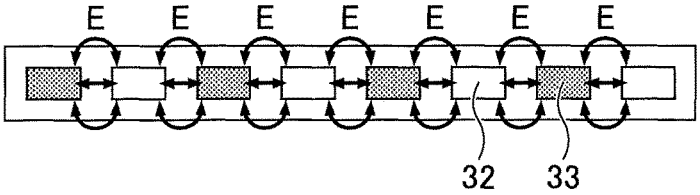

A relay according to a second embodiment is described with reference to FIGS. 3A through 3D. FIG. 3A is an enlarged perspective view of a body of the relay. FIG. 3B is an enlarged plan view of the body of the relay. FIGS. 3C and 3D are a plan view and a sectional view, respectively, of collecting electrodes. In FIGS. 3A and 3B, the base 21 is made transparent to illustrate the collecting electrodes.

The relay includes a pair of collecting electrodes 32 and 33 provided near the fixed contact 12 and the movable contact 14. The pair is buried in the base 21 to be positioned on the opposite sides of the fixed contact 12 and the movable contact 14. The collecting electrodes 32 and 33 each have a comb-teeth shape. The paired collecting electrodes 32 and 33 are placed at an interval to face each other with their respective tooth-shaped portions alternating with each other without contact. The distance between the collecting electrodes 32 and 33 is uniform. Terminals 32*a* and 33*a* are connected to the collecting electrodes 32 and 33, respectively, to protrude from the base 21. Thus, the terminals 32*a* and 33*a* are exposed outside the package. In other respects than those described above, the second embodiment may be the same as the first embodiment.

The collecting electrodes 32 and 33 are buried and held in the base 21, being spaced apart from each other, and the terminals 32*a* and 33*a* are held on the base 21. The fixed contact part 12*a* and the movable contact part 14*a* are insulated from the collecting electrodes 32 and 33, and the collecting electrodes 32 and 33 are insulated from each other.

When a voltage is applied to the terminals 32*a* and 33*a*, an electric field E is generated between the collecting electrodes 32 and 33. As a result, it is possible to attract and collect a charged foreign substance to control the adhesion of the foreign substance to the fixed contact 12 and the movable contact 14. The electric field E generated between the collecting electrodes 32 and 33 is preferably greater than the electric field generated between the fixed contact 12 and the movable contact 14. This makes it possible to improve the effect that the collecting electrodes 32 and 33 attract and collect a charged foreign substance to control the foreign substance's approaching the fixed contact 12 and the movable contact 14.

Third Embodiment

Figure 4A:
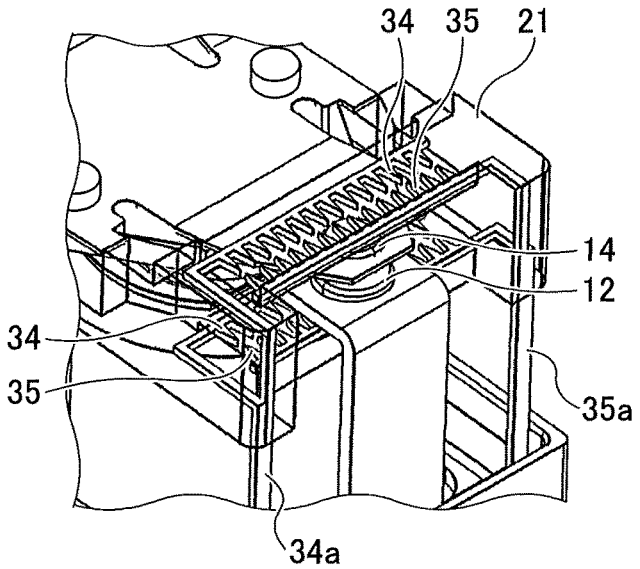
FIG. 4A is an enlarged perspective view of a body of a relay according to a third embodiment.
Figure 4B:
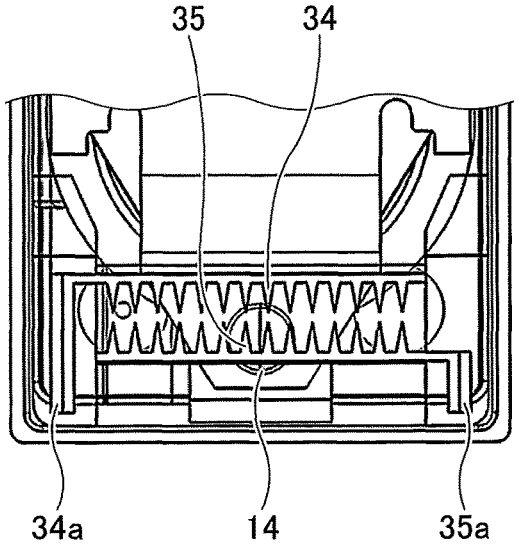
FIG. 4B is an enlarged plan view of the body according to the third embodiment.
Figure 4C:
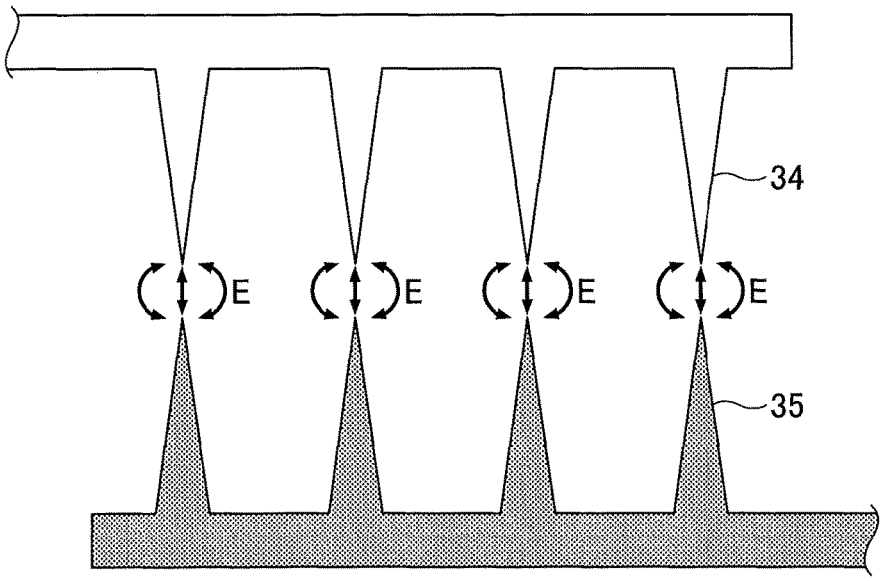
FIG. 4C is a plan view of collecting electrodes according to the third embodiment.

A relay according to a third embodiment is described with reference to FIGS. 4A through 4C. FIG. 4A is an enlarged perspective view of a body of the relay. FIG. 4B is an enlarged plan view of the body of the relay. FIG. 4C is a plan view of collecting electrodes. In FIGS. 4A and 4B, the base 21 is made transparent to illustrate the collecting electrodes.

The relay includes a pair of collecting electrodes 34 and 35 provided near the fixed contact 12 and the movable contact 14. The pair is buried in the base 21 to be positioned on the opposite sides of the fixed contact 12 and the movable contact 14. Each of the collecting electrodes 34 and 35 has a saw-toothed shape in which multiple sharp-pointed protrusions are arranged. The collecting electrodes 34 and 35 are placed to face each other with their respective sharp-pointed ends pointing toward each other. Terminals 34*a* and 35*a* are connected to the collecting electrodes 34 and 35, respectively, to protrude from the base 21 to be exposed outside the package. In other respects than those described above, the third embodiment may be the same as the first embodiment.

The collecting electrodes 34 and 35 are buried and held in the base 21, being spaced apart from each other, and the terminals 34*a* and 35*a* are held on the base 21. The fixed contact part 12*a* and the movable contact part 14*a* are insulated from the collecting electrodes 34 and 35, and the collecting electrodes 34 and 35 are insulated from each other.

When a voltage is applied to the terminals 34*a* and 35*a*, an electric field E is generated between the respective ends of the collecting electrodes 34 and 35. As a result, it is possible to attract and collect a charged foreign substance to control the foreign substance's approaching the fixed contact 12 and the movable contact 14. The electric field E generated between the collecting electrodes 34 and 35 is preferably greater than the electric field generated between the fixed contact 12 and the movable contact 14. This makes it possible to improve the effect that the collecting electrodes 34 and 35 attract and collect a charged foreign substance to control the foreign substance's approaching the fixed contact 12 and the movable contact 14.

Fourth Embodiment

Figure 5A:
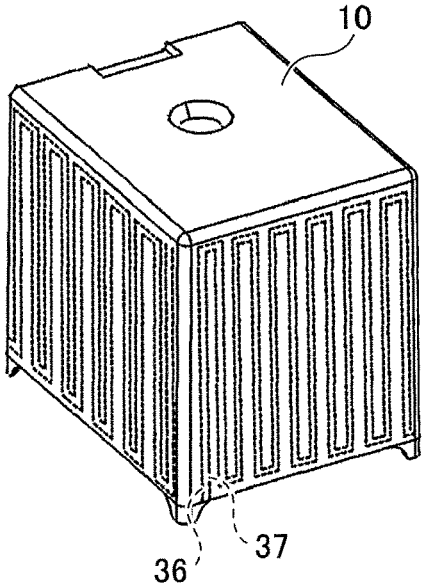
FIG. 5A is a perspective view of a cover of a relay according to a fourth embodiment.
Figure 5B:
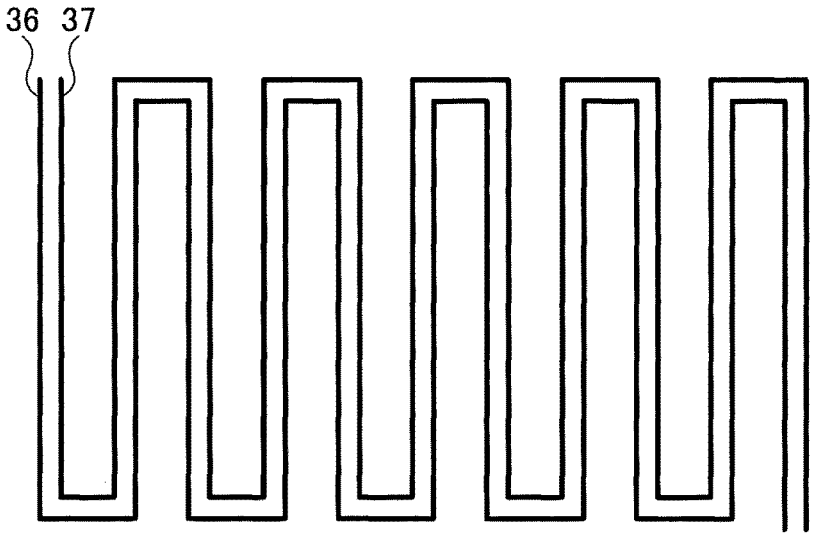
FIGS. 5B and 5C are a plan view and a sectional view, respectively, of collecting electrodes according to the fourth embodiment.
Figure 5C:
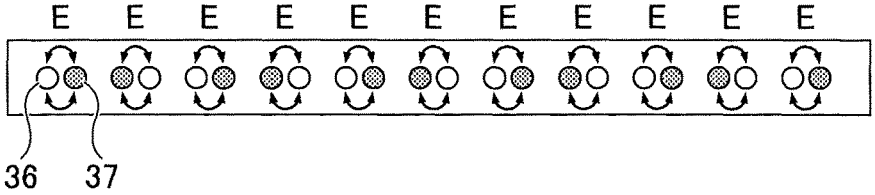

A relay according to a fourth embodiment is described with reference to FIGS. 5A through 5C. FIG. 5A is a perspective view of a cover of the relay. FIGS. 5B and 5C are a plan view and a sectional view, respectively, of collecting electrodes.

The relay includes a pair of collecting electrodes 36 and 37 buried in the cover 10, being spaced apart from and facing each other. Each of the collecting electrodes 36 and 37 is formed by processing a linear electrode material into a meandering shape by bending. The collecting electrodes 36 and 37 are kept parallel to each other. The distance between the collecting electrodes 36 and 37 is uniform. Part of the collecting electrode 36 and part of the collecting electrode 37 are exposed at a surface of the cover 10 to define terminals. In other respects than those described above, the fourth embodiment may be the same as the first embodiment.

The fixed contact part 12*a* and the movable contact part 14*a* are insulated from the collecting electrodes 36 and 37.

When a voltage is applied to the collecting electrodes 36 and 37, an electric field E is generated between the collecting electrodes 36 and 37. The electric field E acts on a region inside the cover 10 from the inside surface of the cover 10, thus making it possible to attract and collect a charged foreign substance to control the foreign substance's approaching the fixed contact 12 and the movable contact 14 and control the adhesion of the foreign substance to the fixed contact 12 and the movable contact 14. The electric field E generated between the collecting electrodes 36 and 37 is preferably greater than the electric field generated between the fixed contact 12 and the movable contact 14. This makes it possible to improve the effect that the collecting electrodes 36 and 37 attract and collect a charged foreign substance to control the foreign substance's approaching the fixed contact 12 and the movable contact 14.

Fifth Embodiment

Figure 6A:
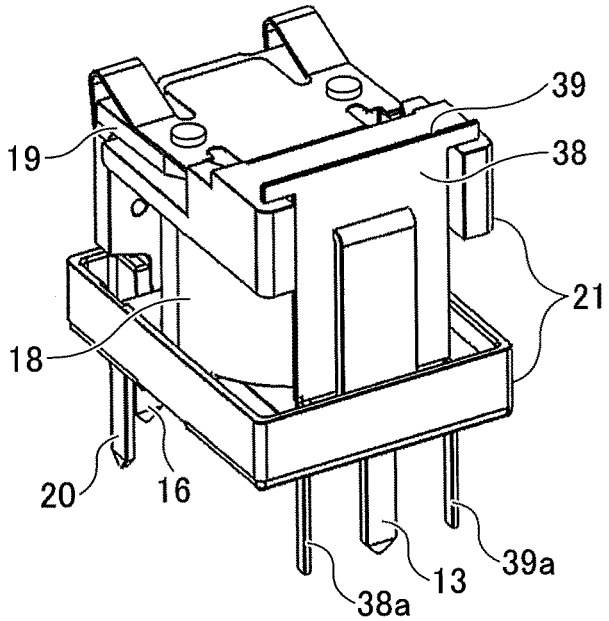
FIG. 6A is a perspective view of a body of a relay according to a fifth embodiment.
Figure 6B:
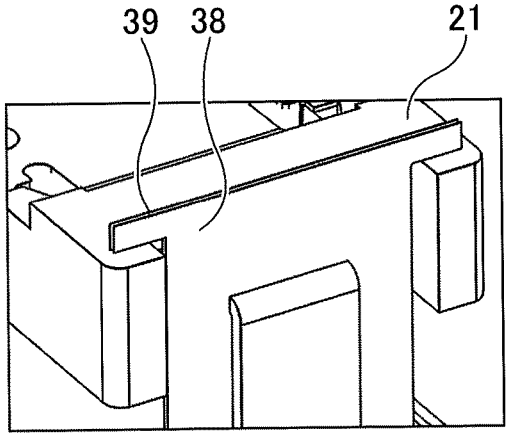
FIG. 6B is an enlarged perspective view of the body according to the fifth embodiment.
Figure 7A:
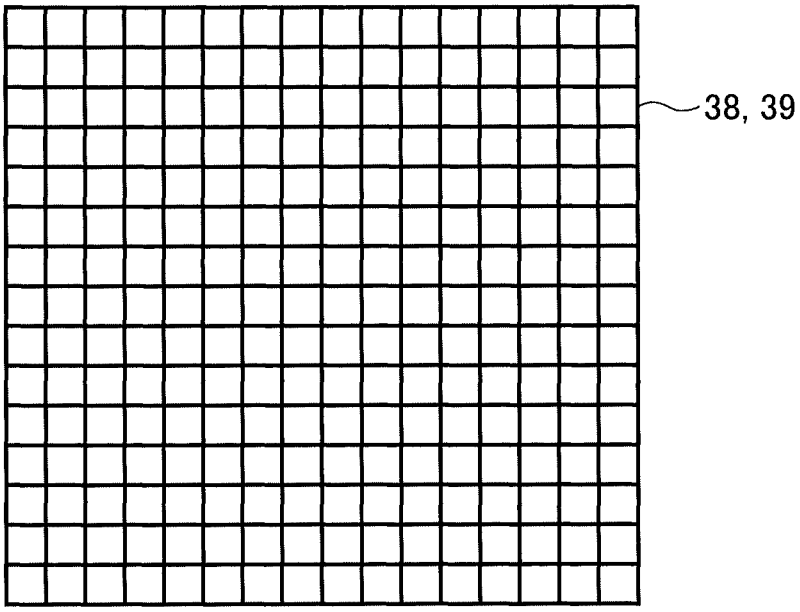
FIGS. 7A, 7B and 7C are a front view, a side view and a sectional view, respectively, of collecting electrodes according to the fifth embodiment.
Figure 7B:
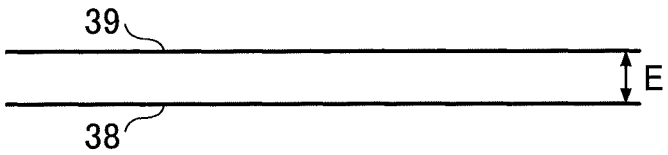
Figure 7C:
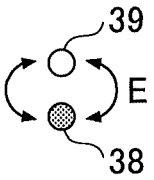

A relay according to a fifth embodiment is described with reference to FIGS. 6A, 6B and 7A through 7C. FIG. 6A is a perspective view of a body of the relay. FIG. 6B is an enlarged perspective view of the body. FIGS. 7A, 7B and 7C are a front view, a side view, and a sectional view, respectively, of collecting electrodes according to this embodiment.

The relay includes a pair of collecting electrodes 38 and 39 provided to face each other near the fixed contact 12 and the movable contact 14. Each of the collecting electrodes 38 and 39 is formed by processing a linear electrode material in a lattice shape. The collecting electrodes 38 and 39 are disposed with surfaces of the collecting electrodes 38 and 39 facing each other. Terminals 38*a* and 3*a* are connected to and extend from the collecting electrodes 38 and 39, respectively, to protrude from the base 21. Thus, the terminals 38*a* and 39*a* are exposed outside the package. In other respects than those described above, the fifth embodiment may be the same as the first embodiment.

The collecting electrodes 38 and 39 are held on the base 21, being spaced apart from each other, and the terminals 38*a* and 39*a* are held on the base 21. The fixed contact part 12*a* and the movable contact part 14*a* are insulated from the collecting electrodes 38 and 39.

When a voltage is applied to the terminals 38*a* and 39*a*, an electric field E is generated between the collecting electrodes 38 and 39. As a result, it is possible to attract and collect a charged foreign substance to control the adhesion of the foreign substance to the fixed contact 12 and the movable contact 14. The electric field E generated between the collecting electrodes 38 and 39 is preferably greater than the electric field generated between the fixed contact 12 and the movable contact 14. This makes it possible to improve the effect that the collecting electrodes 38 and 39 attract and collect a charged foreign substance to control the foreign substance's approaching the fixed contact 12 and the movable contact 14.

Sixth Embodiment

Figure 8A:
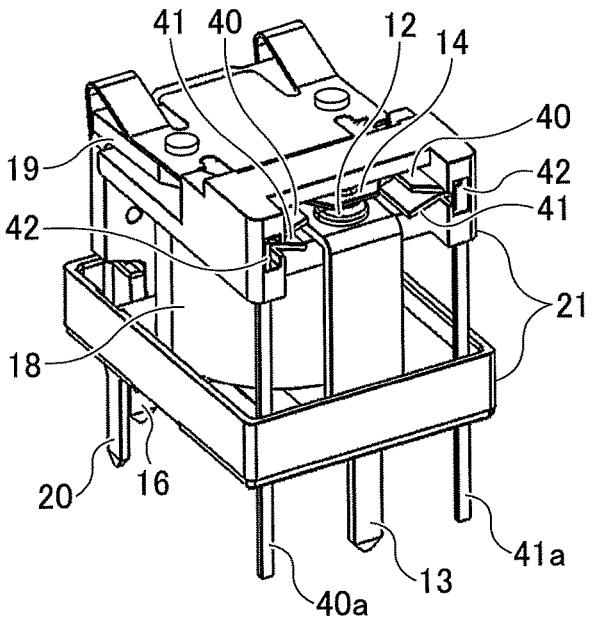
FIGS. 8A and 8B are a perspective view and a front view, respectively, of a body of a relay according to a sixth embodiment.
Figure 8B:
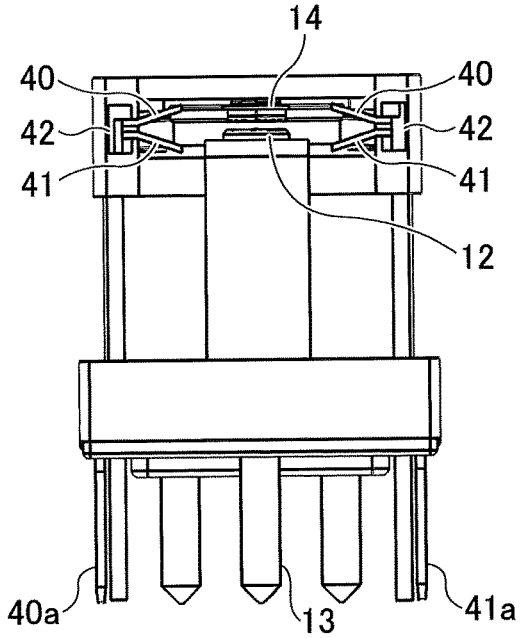
Figure 8C:
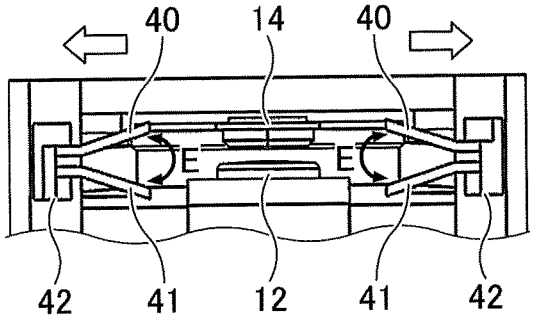
FIG. 8C is an enlarged front view of the body according to the sixth embodiment.
Figure 8D:
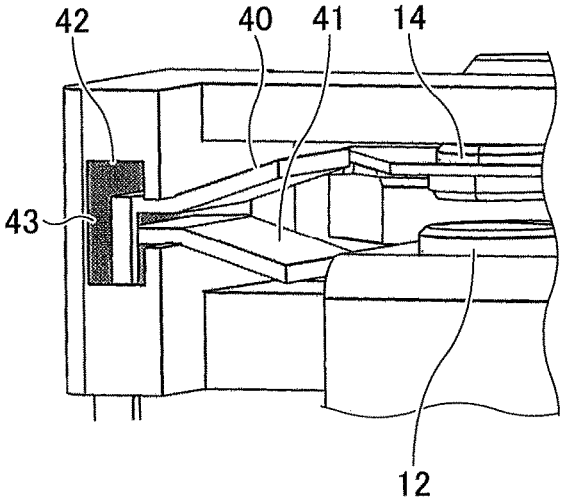
FIG. 8D is an enlarged perspective view of the body according to the sixth embodiment.

A relay according to a sixth embodiment is described with reference to FIGS. 8A through 8D. FIGS. 8A and 8B are a perspective view and a front view, respectively, of a body of the relay. FIG. 8C is an enlarged front view of the body. FIG. 8D is an enlarged perspective view of the body.

According to the relay, the base 21 has two recesses 42 for collecting a foreign substance provided around the fixed contact 12 and the movable contact 14. Two pairs of collecting electrodes 40 and 41 are provided one extending from each recess 42 toward the fixed contact 12 and the movable contact 14 with the collecting electrodes 40 and 41 facing each other. While this embodiment illustrates a relay where the two recesses 42 and the two pairs of collecting electrodes 40 and 41 are provided, a relay may be provided with a single recess and a single pair of collecting electrodes. Each of the collecting electrodes 40 and 41 has a plate shape including a bend. The paired collecting electrodes 40 and 41 are close and parallel to each other near the base 21. On the contacts 12 and 14 side of these parallel portions, the paired collecting electrodes 40 and 41 are angled relative to the parallel portions to gradually increase a distance between the collecting electrodes 40 and 41 as the distance to the contacts 12 and 14 decreases. Furthermore, an adhesive 43 is provided on the surfaces of or near the paired collecting electrodes 40 and 41, for example, on the inner wall of each recess 42. Terminals 40*a* and 41*a* are connected to one and the other of the collecting electrodes 40 and 41, respectively. The terminals 40*a* and 41*a* extend from the corresponding pairs of collecting electrodes 40 and 41 to protrude from the base 21 to be exposed outside the package. In other respects than those described above, the sixth embodiment may be the same as the first embodiment.

The collecting electrodes 40 and 41 and the terminals 40*a* and 41*a* are held on the base 21 such that the fixed contact part 12*a* and the movable contact part 14*a* are spaced apart and insulated from the collecting electrodes 40 and 41 and that the paired collecting electrodes 40 and 41 are spaced apart and insulated from each other.

When a voltage is applied to the terminals 40*a* and 41*a*, an electric field E is generated between the collecting electrodes 40 and 41 of each pair, so that it is possible to attract and collect a charged foreign substance to control the foreign substance's approaching the fixed contact 12 and the movable contact 14. Here, as the distance from the contacts 12 and 14 increases, the distance between the collecting electrodes 40 and 41 gradually decreases to be minimized near the base 21. That is, the electric field E between the collecting electrodes 40 and 41 increases as the distance to the base 21 in a direction away from the contacts 12 and 14 decreases, and is maximized near the base 21. Because the interval between the collecting electrodes 40 and 41 is partly non-uniform, the electric field E has a magnitude gradient. This makes it possible to guide a foreign substance to a position where the electric field E is greater. According to this embodiment, each recess 42 is formed in the base 21 in the neighborhood of where the electric field E due to the collecting electrodes 40 and 41 is maximized. Therefore, foreign substances are likely to be guided and collected to the recesses 42. In addition, because the adhesive 43 is provided on the inner surface of each recess 42, it is possible to collect the foreign substances guided to the recesses 42 by causing the foreign substances to stick to the adhesive 43. This makes it possible to improve the effect that the collecting electrodes 40 and 41 attract and collect a charged foreign substance to control the foreign substance's approaching the fixed contact 12 and the movable contact 14.

The place where the recesses 42 are provided is not limited to the base 21, and the recesses 42 may be provided in the inside surface of the cover 10, which is another insulating member.

Seventh Embodiment

Figure 9A:
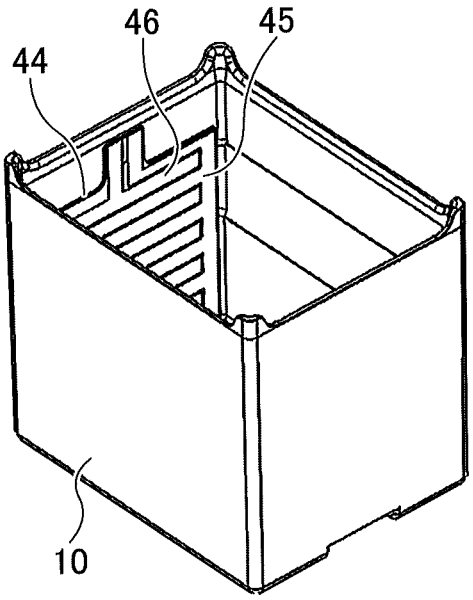
FIG. 9A is a perspective view of a cover of a relay according to a seventh embodiment.
Figure 9B:
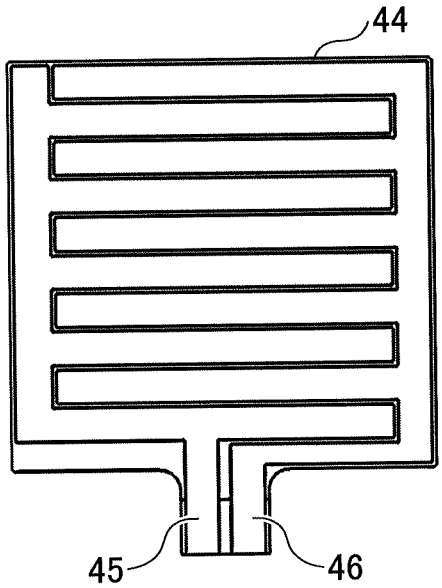
FIG. 9B is a plan view of collecting electrodes according to the seventh embodiment.

A relay according to a seventh embodiment is described with reference to FIGS. 9A and 9B. FIG. 9A is a perspective view of a cover of the relay. FIG. 9B is a plan view of collecting electrodes.

The relay includes a printed board 44 and a pair of collecting electrodes 45 and 46 patterned on the printed board 44, facing each other. The printed board 44 is provided on the inside surface of the cover 10. The collecting electrodes 45 and 46 each have a comb-teeth shape and are placed at an interval with their respective tooth-shaped portions alternating with each other without contact. The respective ends of the collecting electrodes 45 and 46 on the printed board 44 define terminals. In other respects than those described above, the seventh embodiment may be the same as the first embodiment.

The collecting electrodes 45 and 46 are spaced from each other. The fixed contact part 12*a* and the movable contact part 14*a* are insulated from the collecting electrodes 45 and 46.

When a voltage is applied to the collecting electrodes 45 and 46, an electric field is generated between the collecting electrodes 45 and 46. The electric field acts on a region inside the cover 10 from the inside surface of the cover 10, thus making it possible to attract and collect a charged foreign substance to control the foreign substance's approaching the fixed contact 12 and the movable contact 14 to control the adhesion of the foreign substance to the fixed contact 12 and the movable contact 14. The electric field generated between the collecting electrodes 45 and 46 is preferably greater than the electric field generated between the fixed contact 12 and the movable contact 14. This makes it possible to improve the effect that the collecting electrodes 45 and 46 attract and collect a charged foreign substance to control the foreign substance's approaching the fixed contact 12 and the movable contact 14.

Eighth Embodiment

Figure 10A:
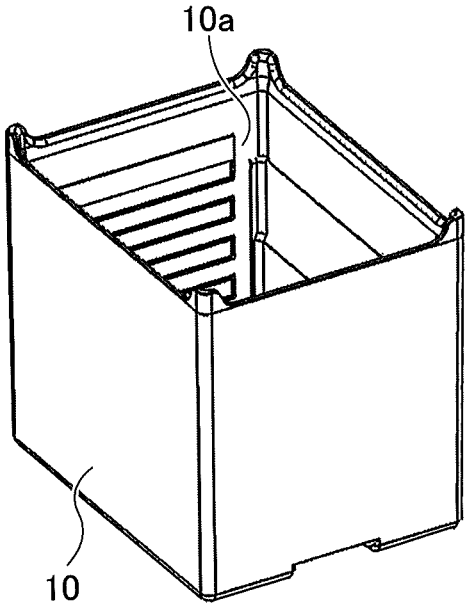
FIG. 10A is a perspective view of a cover of a relay before forming collecting electrodes according to an eighth embodiment.
Figure 10B:
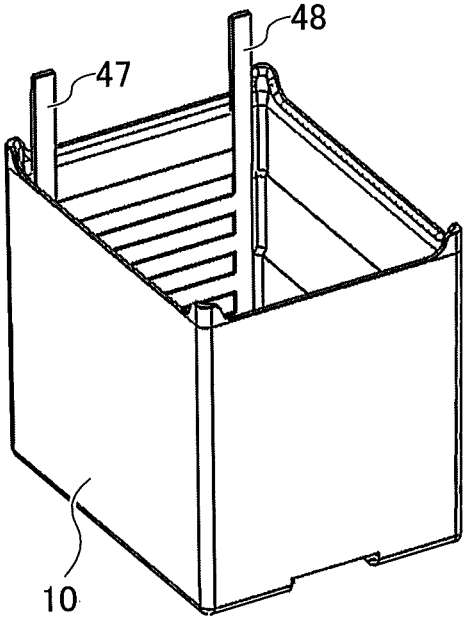
FIG. 10B is a perspective view of the cover after forming collecting electrodes according to the eighth embodiment.

A relay according to an eighth embodiment is described with reference to FIGS. 10A and 10B. FIG. 10A is a perspective view of a cover of the relay before collecting electrodes are formed. FIG. 10B is a perspective view of the cover after the collecting electrodes are formed.

The relay includes comb-teeth-shaped collecting electrodes 47 and 48 placed in a groove 10*a* formed in the inside surface of the cover 10. The respective ends of the collecting electrodes 47 and 48 define terminals. In other respects than those described above, the eighth embodiment may be the same as the first embodiment.

The collecting electrodes 47 and 48 are spaced from each other. The fixed contact part 12*a* and the movable contact part 14*a* are insulated from the collecting electrodes 47 and 48.

When a voltage is applied to the collecting electrodes 47 and 48, an electric field is generated between the collecting electrodes 47 and 48. The electric field acts on a region inside the cover 10 from the inside surface of the cover 10, thus making it possible to attract and collect a charged foreign substance to control the foreign substance's approaching the fixed contact 12 and the movable contact 14 to control the adhesion of the foreign substance to the fixed contact 12 and the movable contact 14. The electric field generated between the collecting electrodes 47 and 48 is preferably greater than the electric field generated between the fixed contact 12 and the movable contact 14. This makes it possible to improve the effect that the collecting electrodes 47 and 48 attract and collect a charged foreign substance.

Ninth Embodiment

Figure 11A:
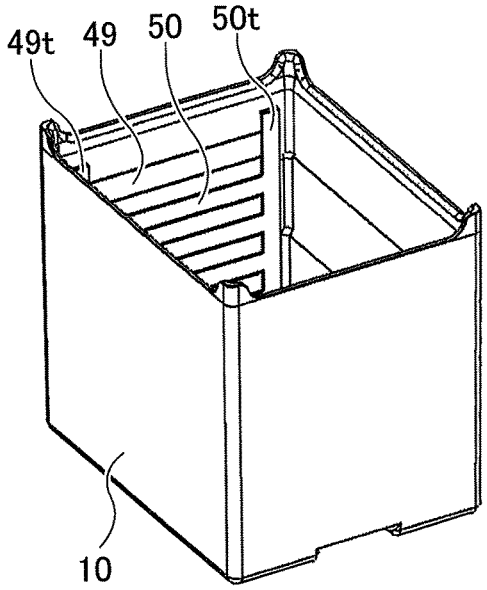
FIG. 11A is a perspective view of a cover of a relay according to a ninth embodiment.
Figure 11B:
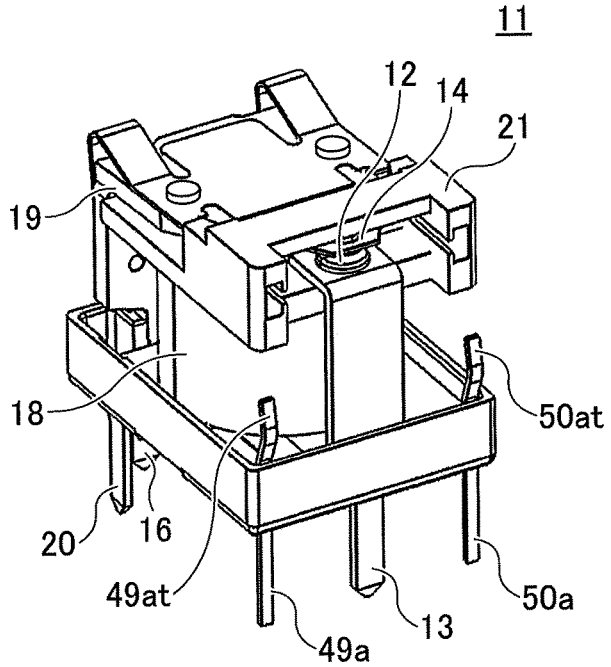
FIG. 11B is a perspective view of a body of the relay according to the ninth embodiment.

A relay according to a ninth embodiment is described with reference to FIGS. 11A and 11B. FIG. 11A is a perspective view of a cover of the relay. FIG. 11B is a perspective view of a body of the relay.

The relay includes comb-teeth-shaped collecting electrodes 49 and 50 plated on the inside surface of the cover 10. Terminals 49*a* and 50*a* for the collecting electrodes 49 and 50, respectively, are held on the base 21. When the cover 10 having the collecting electrodes 49 and 50 formed on its inside surface is placed on the body 11 on which the terminals 49*a* and 50*a* are provided, ends 49*t* and 50*t* of the collecting electrodes 49 and 50 connect to ends 49*at* and 50*at* of the terminals 49*a* and 50*a*, respectively. The terminals 49*a* and 50*a* are exposed outside the package. In other respects than those described above, the ninth embodiment may be the same as the first embodiment.

The collecting electrodes 49 and 50 are spaced from each other. The fixed contact part 12*a* and the movable contact part 14*a* are insulated from the collecting electrodes 49 and 50.

When a voltage is applied to the collecting electrodes 49 and 50, an electric field is generated between the collecting electrodes 49 and 50. The electric field acts on a region inside the cover 10, thus making it possible to attract and collect a charged foreign substance to control the adhesion of the foreign substance to the fixed contact 12 and the movable contact 14. The electric field generated between the collecting electrodes 49 and 50 is preferably greater than the electric field generated between the fixed contact 12 and the movable contact 14. This makes it possible to improve the effect that the collecting electrodes 49 and 50 attract and collect a charged foreign substance to control the foreign substance's approaching the fixed contact 12 and the movable contact 14.

Tenth Embodiment

Figure 12:
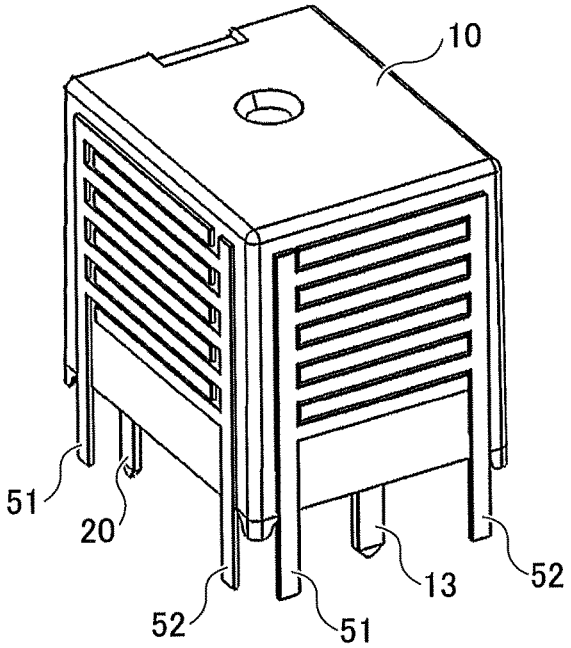
FIG. 12 is a perspective view of a relay according to a tenth embodiment.

A relay according to a tenth embodiment is described with reference to FIG. 12. FIG. 12 is a perspective view of the relay.

The relay includes multiple pairs of comb-teeth-shaped collecting electrodes 51 and 52 provided on the outside surface of the cover 10. The collecting electrodes 51 and 52 of each pair have respective end portions protruding from the bottom of the package. In other respects than those described above, the tenth embodiment may be the same as the first embodiment.

The paired collecting electrodes 51 and 52 are spaced apart from each other on the outside surface of the cover 10.

The fixed contact part 12*a* and the movable contact part 14*a* are insulated from the collecting electrodes 51 and 52.

When a voltage is applied to the collecting electrodes 51 and 52, an electric field is generated between the collecting electrodes 51 and 52 of each pair. Although the collecting electrodes 51 and 52 are provided on the outside surface of the cover 10, the electric field acts on a region inside the cover 10, thus making it possible to attract and collect a charged foreign substance to control the adhesion of the foreign substance to the fixed contact 12 and the movable contact 14. The electric field generated between the collecting electrodes 51 and 52 is preferably greater than the electric field generated between the fixed contact 12 and the movable contact 14. This makes it possible to improve the effect that the collecting electrodes 51 and 52 attract and collect a charged foreign substance to control the foreign substance's approaching the fixed contact 12 and the movable contact 14.

Eleventh Embodiment

Figure 13:
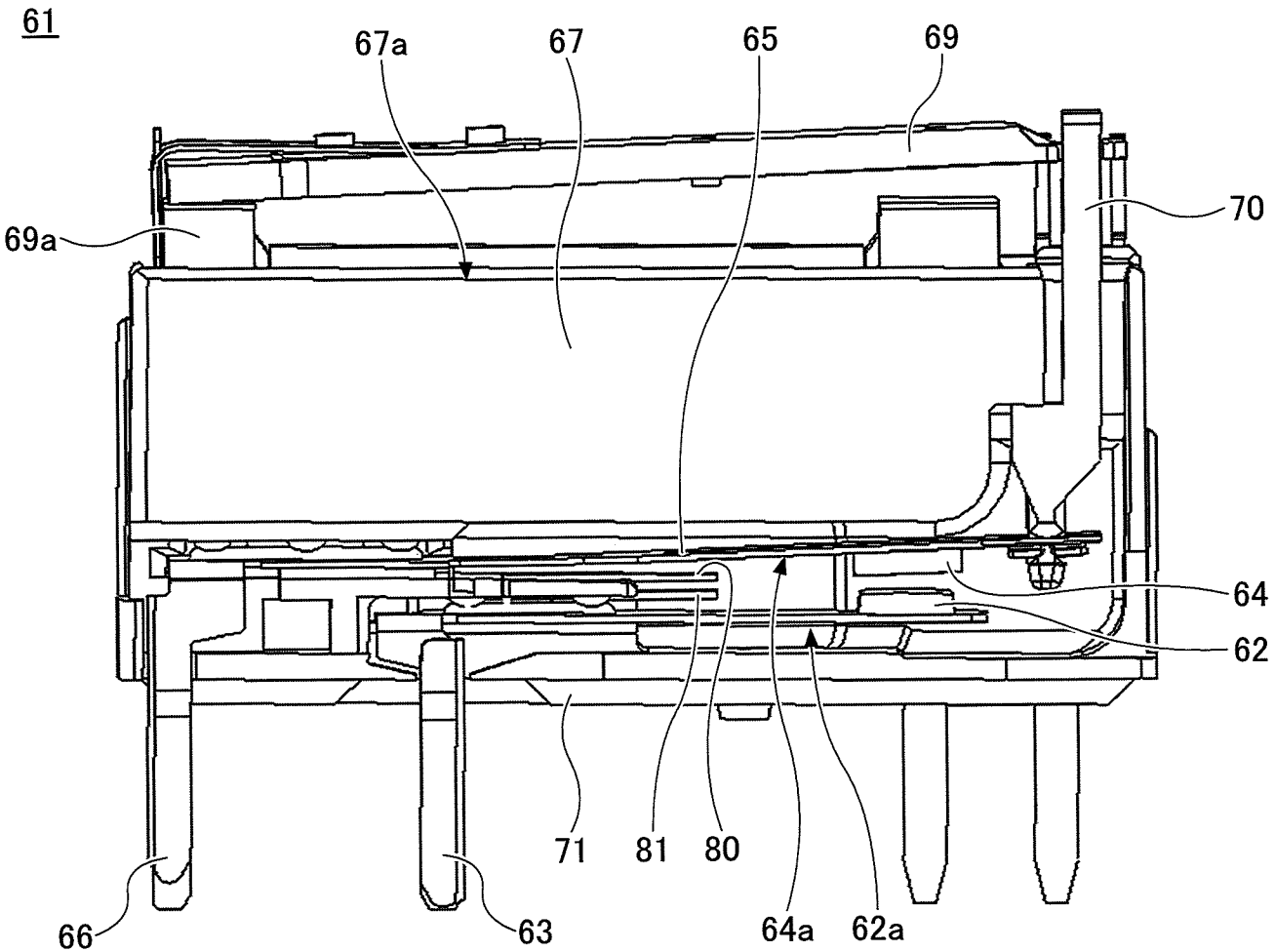
FIG. 13 is a side view of a body of a relay according to an eleventh embodiment.

A relay according to an eleventh embodiment is described with reference to FIG. 13. FIG. 13 is a side view of a body of the relay.

The relay includes a body 61. The body 61 includes a fixed contact part 62*a* and a movable contact part 64*a*. The fixed contact part 62*a* includes a fixed terminal 63 and a fixed contact 62. The movable contact part 64*a* includes a movable spring 65, a movable contact 64, and a movable terminal 66. The body 61 further includes an electromagnet 67, an armature 69, a card 70 connected to the armature 69, and a base 71. The armature 69 is moved by a magnetic field produced by the electromagnet 67 to move the movable contact part 64*a* to bring the movable contact 64 into contact with the fixed contact 62. The fixed contact part 62*a* and the movable contact part 64*a*, together with the armature 69 and the electromagnet 67, are held on the base 71 with the movable contact 64 facing the fixed contact 62. The lower end of the card 70 is at a position where it is possible to press the movable contact part 64*a*.

The electromagnet M includes an iron core, a bobbin, and a coil wound on the bobbin.

The body 61 further includes a yoke 69*a* to which the armature 19 is pivotably attached. A hinge spring is attached to the armature 69 and the yoke 69*a* to urge the armature 69 away from a surface 67*a* of the electromagnet 67.

Next, an operation of the relay is described. With no electric current flowing through the coil of the electromagnet 67, the armature 69 is urged away from the surface 67*a* by the hinge spring. In this state, the card 70 connected to the armature 69 is out of contact with the movable spring 65, and the movable spring 65 is urged away from the fixed contact part 62*a* by its restoring force. As a result, the movable contact 64 is out of contact with the fixed contact 62.

When an electric current flows through the coil, the electromagnet 67 produces a magnetic field, so that the armature 69 is attracted to the surface 67*a* to pivot with a part of the armature 69 connected to the yoke 69*a* as a pivot point. At this time, the card 70 contacts the movable spring 65 to press the movable spring 65 toward the fixed contact part 62*a*. As a result, the movable contact 64 contacts the fixed contact 62. Thus, the fixed terminal 63 and the movable terminal 66 are electrically connected.

When the electric current flowing through the coil is stopped, the magnetic field disappears, so that a force to attract the armature 69 is lost. By the restoring force of the hinge spring, the armature 69 moves away from the surface 67*a*, so that the card 70 is out of contact with the movable spring 65, and the movable spring 65 is urged away from the fixed contact part 62*a* by its restoring force. As a result, the movable contact 64 is out of contact with the fixed contact 62.

Figure 14:
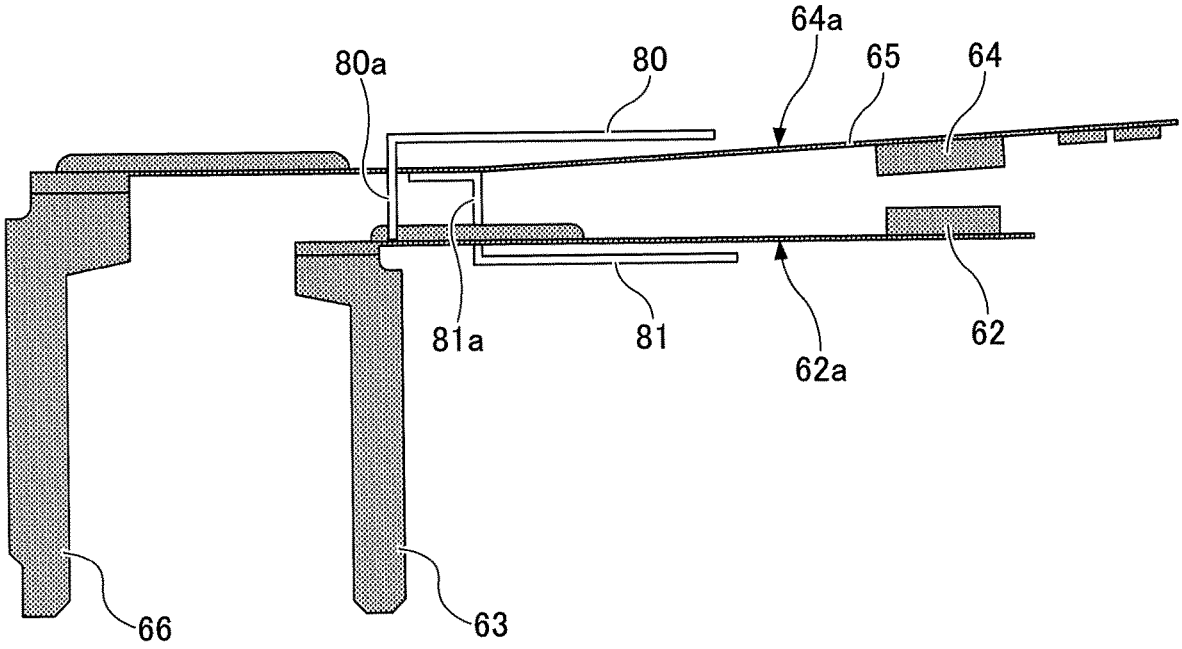
FIG. 14 is a side view of a fixed contact part and a movable contact part of the relay according to the eleventh embodiment.
Figure 15A:
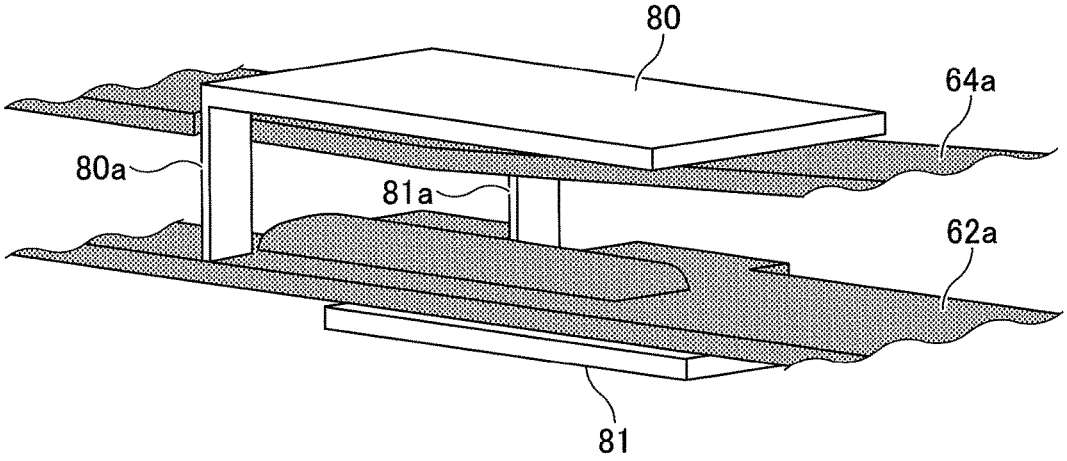
FIGS. 15A and 15B are perspective views of the fixed contact part and the movable contact part according to the eleventh embodiment.
Figure 15B:
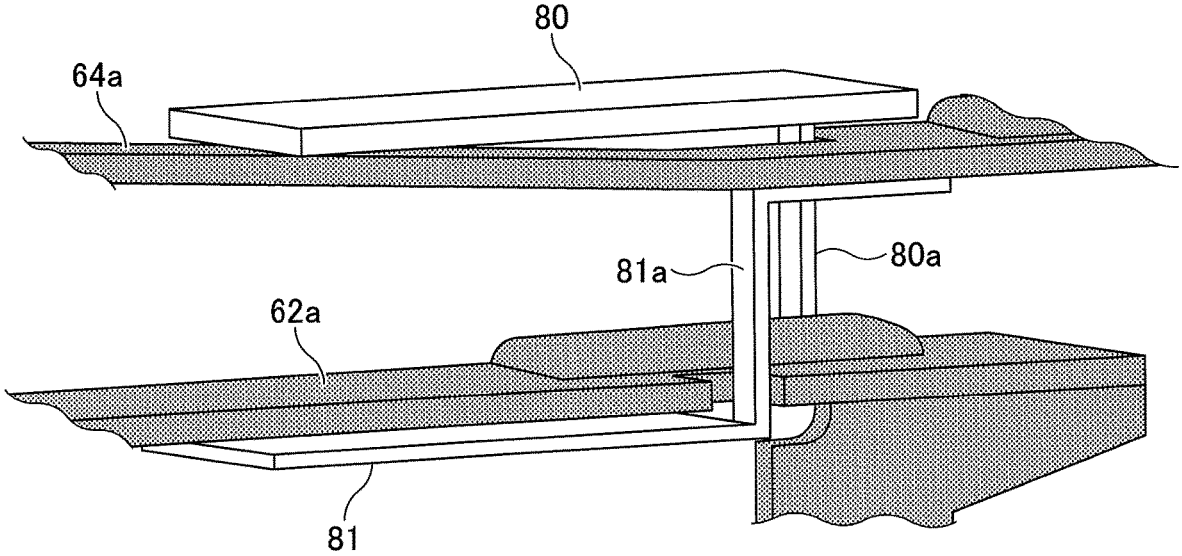

FIG. 14 is a side view of a fixed contact part and a movable contact part of the relay. FIGS. 15A and 15B are perspective views of the fixed contact part and the movable contact part.

The relay includes a pair of flat-plate-shaped collecting electrodes 80 and 81.

The collecting electrode 80 is connected and fixed to the fixed contact part 62*a* by a connecting part 80*a*, and faces the movable contact part 64*a*. The collecting electrode 81 is connected and fixed to the movable contact part 64*a* by a connecting part 81*a*, and faces the fixed contact part 62*a*. The collecting electrodes 80 and 81 are disposed with a sufficient margin from the fixed contact part 62*a* or the movable contact part 64*a* so as not to contact the fixed contact part 62*a* or the movable contact part 64*a* during the driving of the relay. While the collecting electrode 81 is positioned below the fixed contact part 62*a* and the collecting electrode 80 is positioned above the movable contact part 64*a* in the illustration of FIGS. 14, 15A and 15B, the collecting electrodes 80 and 81 may alternatively be positioned between the fixed contact part 62*a* and the movable contact part 64*a* as illustrated in FIG. 13.

When a voltage is applied to the fixed contact part 62*a*, an electric field is generated between the collecting electrode 80 and the movable contact part 64*a* that face each other. When a voltage is applied to the movable contact part 64*a*, an electric field is generated between the collecting electrode 81 and the fixed contact part 62*a* that face each other. The electric fields thus generated can attract and collect a charged foreign substance to control the foreign substance's approaching the fixed contact 12 and the movable contact 14, thus reducing the possibility of contact failure.

According to this embodiment, when the fixed contact 62 and the movable contact 64 are out of contact, an electric field is generated between the collecting electrode 80 and the movable contact part 64*a* and between the collecting electrode 81 and the fixed contact part 62*a*. When the fixed contact 62 and the movable contact 64 are in contact, the electric fields are not generated because the fixed contact part 62*a* and the movable contact part 64*a* are at the same potential.

According to the above-described relay, by causing the distance between the collecting electrode 80 and the movable contact part 64*a* or the distance between the collecting electrode 81 and the fixed contact part 62*a* to be smaller than the distance between the fixed contact 62 and the movable contact 64, an electric field greater than the electric field generated between the fixed contact 62 and the movable contact 64 can be generated with the collecting electrode 80 or 81.

For example, it is assumed that the distance between the fixed contact 62 and the movable contact 64 is 0.3 mm, the distance between the collecting electrode 80 and the movable contact part 64*a* or the distance between the collecting electrode 81 and the fixed contact part 62*a* is 0.1 mm, and the applied voltage is common to these contacts and electrodes, 5 V, for example. In this case, as the magnitude of the generated electric field is inversely proportional to the square of the distance, the electric field generated between the collecting electrode 81 and the fixed contact part 62*a* or between the collecting electrode 80 and the movable contact part 64*a* is nine times as large as the electric field generated between the fixed contact 62 and the movable contact 64. As a result, it is possible to improve the effect of attracting and collecting a charged foreign substance with the collecting electrodes 80 and 81 to control the foreign substance's approaching the fixed contact 62 and the movable contact 64.

Twelfth Embodiment

Figure 16:
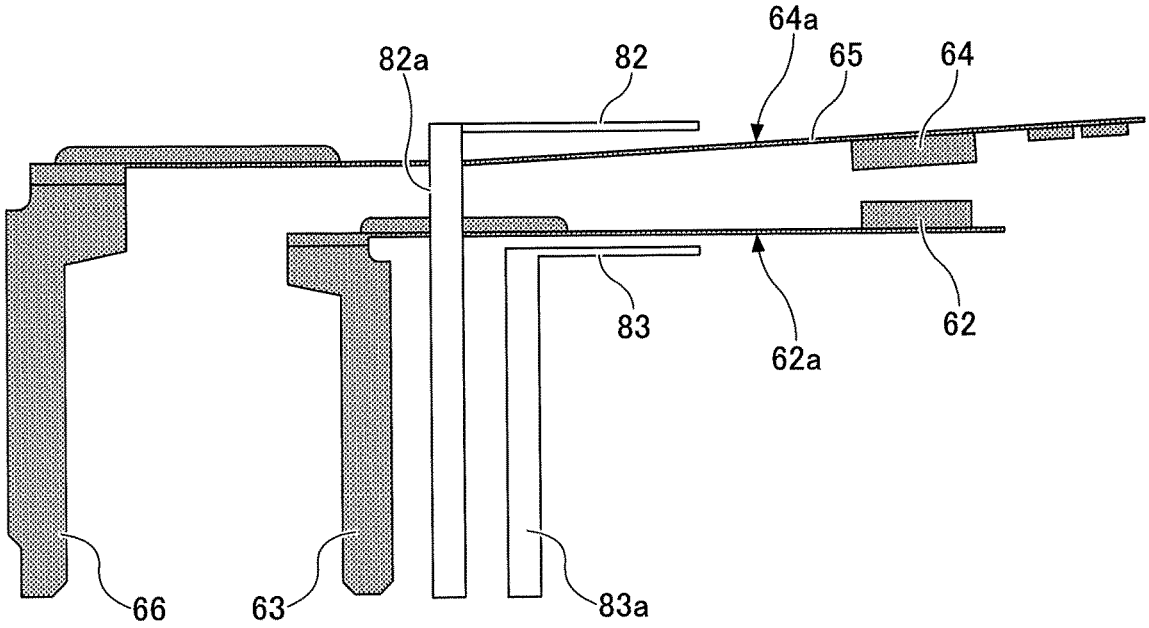
FIGS. 16 and 17 are a side view and a perspective view, respectively, of a fixed contact part and a movable contact part according to a twelfth embodiment.
Figure 17:
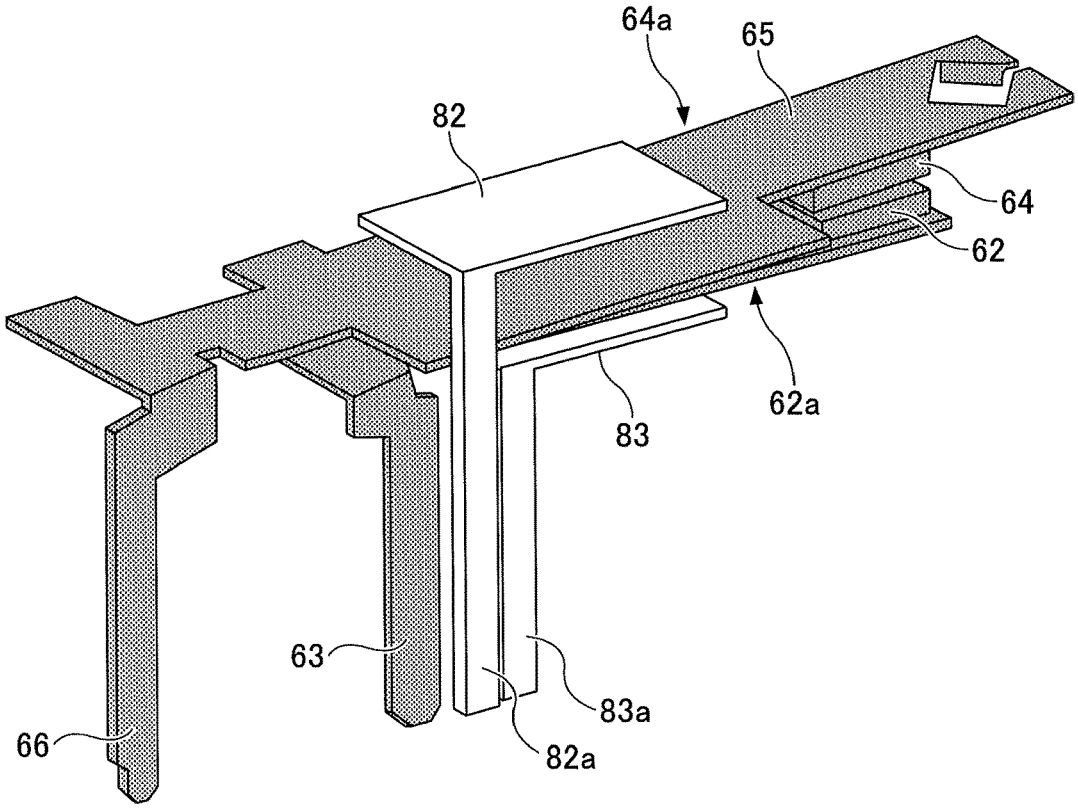

A relay according to a twelfth embodiment is described with reference to FIGS. 16 and 17. FIGS. 16 and 17 are a side view and a perspective view, respectively, of a fixed contact part and a movable contact part of the relay.

The relay includes a pair of collecting electrodes 82 and 83 each having a flat plate shape.

The collecting electrode 82 facing the movable contact part 64*a* is connected to a terminal 82*a*. The collecting electrode 83 facing the fixed contact part 62*a* is connected to a terminal 83*a*. The collecting electrodes 82 and 83 are disposed with a sufficient margin from the fixed contact part 62*a* or the movable contact part 64*a* so as not to contact the fixed contact part 62*a* or the movable contact part 64*a* during the driving of the relay. In other respects than those described above, the twelfth embodiment may be the same as the eleventh embodiment.

When a voltage is applied from the terminal 82*a*, an electric field is generated between the collecting electrode 82 and the movable contact part 64*a*. When a voltage is applied from the terminal 83*a*, an electric field is generated between the collecting electrode 83 and the fixed contact part 62*a*. The electric fields thus generated can attract and collect a charged foreign substance to the collecting electrode 82 or 83 to control the foreign substance's approaching the fixed contact 62 and the movable contact 64, thus reducing the possibility of contact failure.

According to this embodiment, the collecting electrode 82 is connected to neither the fixed contact part 62*a* nor the fixed terminal 63, and the collecting electrode 83 is connected to neither the movable contact part 64*a* nor the movable terminal 66. Therefore, the collecting electrodes 82 and 83 can generate an electric field for collecting a foreign substance whether the fixed contact 62 and the movable contact 64 are in contact or out of contact.

According to the above-described configuration, by (a) causing the distance between the collecting electrode 82 and the movable contact part 64*a* to be smaller than the distance between the fixed contact 62 and the movable contact 64, (b) causing the distance between the collecting electrode 83 and the fixed contact part 62*a* to be smaller than the distance between the fixed contact 62 and the movable contact 64, or (c) causing the voltage difference between the collecting electrode 82 or 83 and the movable contact part 64*a* or the fixed contact part 62*a* to be greater than the voltage difference between the movable contact 64 and the fixed contact 62, an electric field greater than the electric field generated between the fixed contact 62 and the movable contact 64 can be generated with the collecting electrode 82 or 83. As a result, it is possible to improve the effect of attracting and collecting a charged foreign substance to control the foreign substance's approaching the fixed contact 62 and the movable contact 64.

Thirteenth Embodiment

Figure 18:
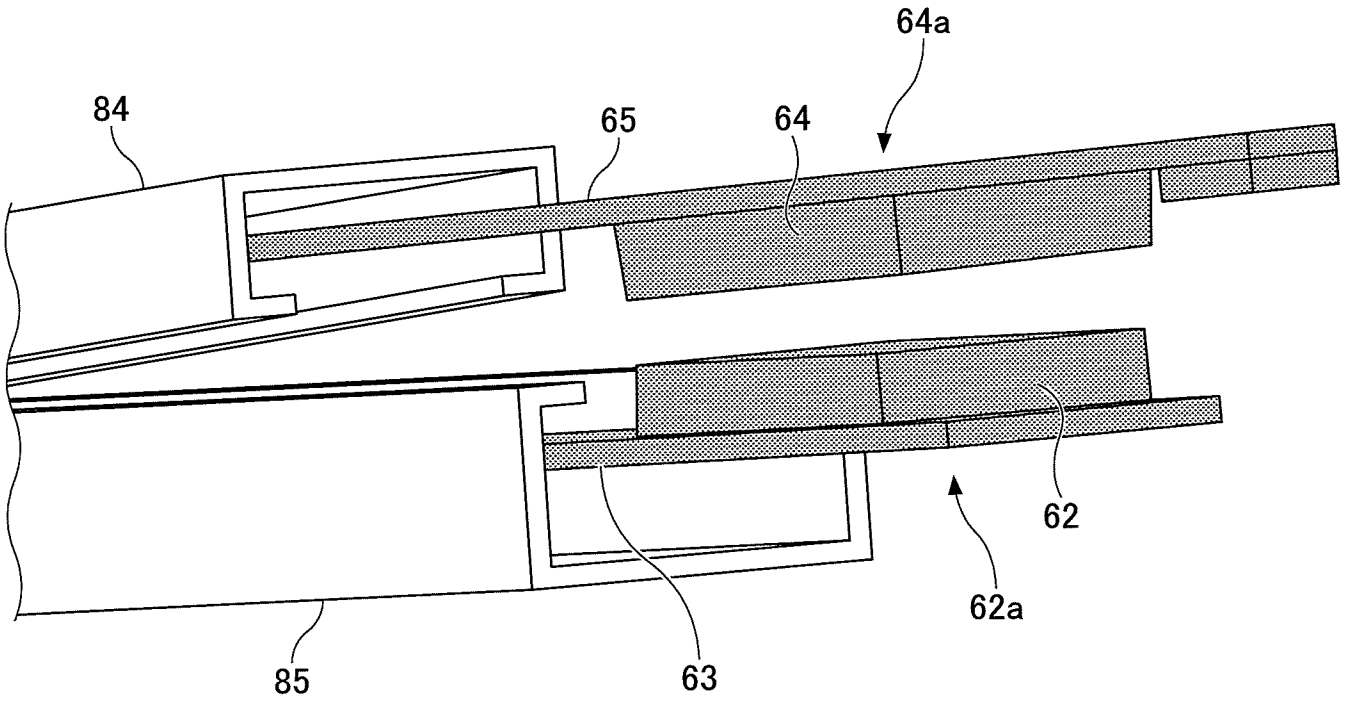
FIG. 18 is a perspective view of a fixed contact part and a movable contact part according to a thirteenth embodiment.

A relay according to a thirteenth embodiment is described with reference to FIG. 18. FIG. 18 is a perspective view of a fixed contact part and a movable contact part of the relay.

The relay includes a pair of collecting electrodes 84 and 85 that are placed to face the movable spring 65 and the fixed terminal 63, respectively. The collecting electrode 85 is provided around the fixed terminal 63 except for a region that interferes with the movement range of the movable spring 65. The collecting electrode 84 is provided around the movable spring 65 except for a region that interferes with the movement range of the movable spring 65. Each of the collecting electrodes 84 and 85 has an angular C-shaped cross section. In other respects than those described above, the thirteenth embodiment may be the same as the eleventh embodiment.

Each of the collecting electrodes 84 and 85 may be connected to the fixed contact part 62*a* or the movable contact part 64*a* so that voltage may be applied to the collecting electrodes 84 and 85 from the fixed contact part 62*a* and the movable contact part 64*a* the same as in the eleventh embodiment. Alternatively, terminals may be connected to the collecting electrodes 84 and 85 to apply voltage to the collecting electrodes 84 and 85 the same as in the twelfth embodiment.

An electric field is generated between the collecting electrode 84 and the movable contact part 64*a* that face each other, and an electric field is generated between the collecting electrode 85 and the fixed contact part 62*a* that face each other. The electric fields thus generated can attract and collect a charged foreign substance to control the foreign substance's approaching the fixed contact 62 and the movable contact 64, thus reducing the possibility of contact failure.

It is possible to enlarge the area of generation of the electric field generated between the collecting electrode 85 and the fixed contact part 62*a*, because the collecting electrode 85 is provided around the fixed terminal 63 except for a region that interferes with the movement range of the movable spring 65. Furthermore, because the collecting electrode 84 is provided around the movable spring 65 except for a region that interferes with the movement range of the movable spring 65, it is possible to generate a greater electric field between the collecting electrode 84 and the movable contact part 64*a*.

Fourteenth Embodiment

Figure 19:
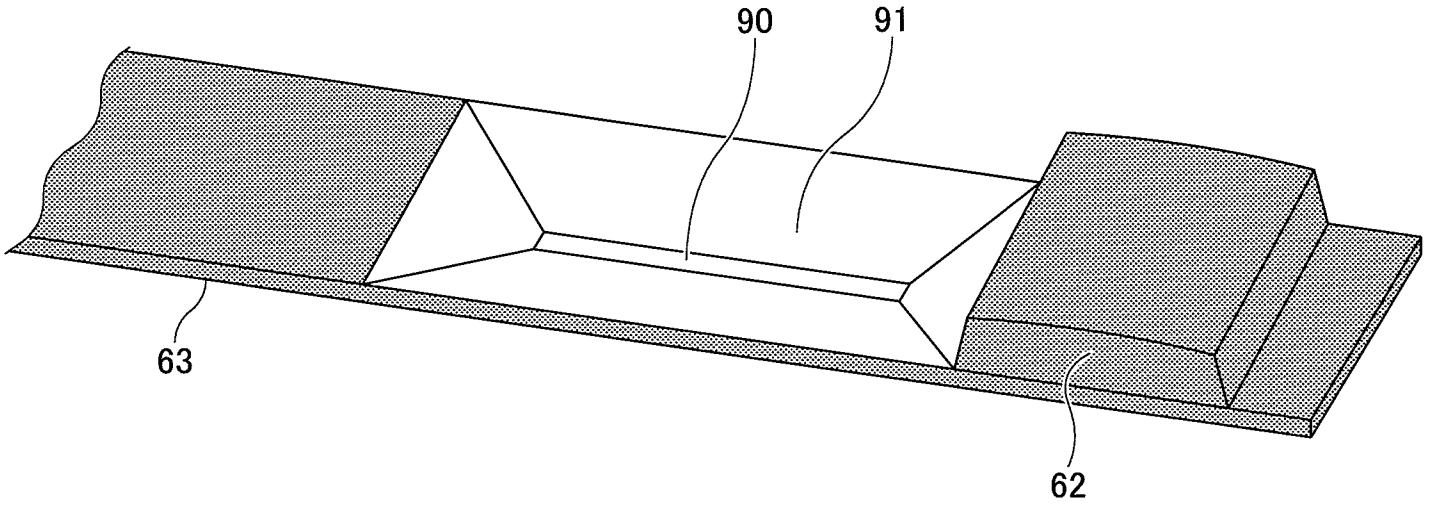
FIG. 19 is a perspective view of a fixed contact part according to a fourteenth embodiment.

A relay according to a fourteenth embodiment is described with reference to FIG. 19. FIG. 19 is a perspective view of a fixed contact part of the relay.

According to the relay, a slit 90 elongated along a longitudinal direction of the fixed terminal 63 is formed in the fixed terminal 63 near the fixed contact 62. Furthermore, slopes 91 are formed on the edges of the slit 90. The slopes 91 are formed within the range of thickness of the fixed terminal 63. In other respects than those described above, the fourteenth embodiment may be the same as any of the eleventh through thirteenth embodiments. By way of example, the following description is given of the case where the relay includes the same collecting electrodes 84 and 85 as in the thirteenth embodiment.

If a foreign substance is present above the fixed terminal 63, the foreign substance has to be collected around the side of the fixed terminal 63 to collect the foreign substance with an electric field generated between the fixed contact part 62*a* and the collecting electrode 85. According to this embodiment, however, the slit 90 and the slopes 91 are provided in the fixed terminal 63. Therefore, it is possible to collect the foreign substance to the collecting electrode 85 through the slit 90. As a result, it is possible to stably collect a foreign substance. A slit may be provided in the movable spring 65.

An electric field is generated between the collecting electrode 84 and the movable contact part 64*a* facing each other, and between the collecting electrode 85 and the fixed contact part 62*a* facing each other. The electric fields thus generated can attract and collect a charged foreign substance to control the foreign substance's approaching the fixed contact 62 and the movable contact 64, thus reducing the possibility of contact failure.

Fifteenth Embodiment

Figure 20A:
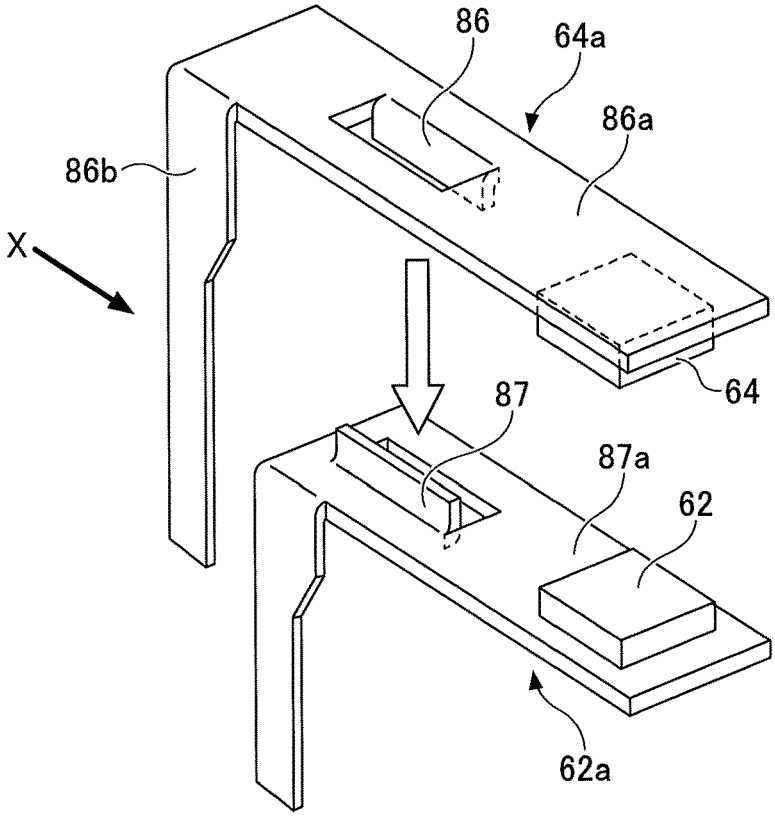
FIGS. 20A and 20B are an exploded perspective view and a side view, respectively, of a fixed contact part and a movable contact part according to a fifteenth embodiment.
Figure 20B:
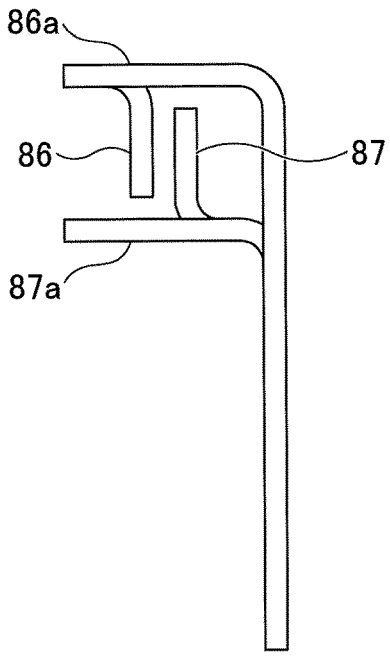

A relay according to a fifteenth embodiment is described with reference to FIGS. 20A and 20B. FIG. 20A is an exploded perspective view of a fixed contact part and a movable contact part of the relay. FIG. 20B is a side view looking at the fixed contact part and the movable contact part in the direction of arrow X of FIG. 20A.

According to the relay, the fixed contact part 62*a* includes a fixed terminal 87*a* on which the fixed contact 62 is provided, and the movable contact part 64*a* includes a movable spring 86*a* and a movable terminal 86*b* connected to the movable spring 86*a*. The movable contact 64 is provided on the movable spring 86*a*. An angular U-shaped cut is formed in the fixed terminal 87*a*, and part of the fixed terminal 87*a* defined by the cut is bent to project toward the movable contact part 64*a* to serve as a collecting electrode 87. An angular U-shaped cut is formed in the movable spring 86*a*, and part of the movable spring 86*a* defined by the cut is bent to project toward the fixed contact part 62*a* to serve as a collecting electrode 86. When the movable contact part 64*a* and the fixed contact part 62*a* are so disposed as to have the movable contact 64 and the fixed contact 62 facing each other, the collecting electrodes 86 and 87 face and are spaced from each other as illustrated in FIG. 20B.

According to the relay, an electric field is generated between the collecting electrodes 86 and 87 facing each other. The generated electric field can attract and collect a charged foreign substance to control the foreign substance's approaching the fixed contact 62 and the movable contact 64 to control the adhesion of the foreign substance to the fixed contact 62 and the movable contact 64, thus reducing the possibility of contact failure.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

While the relays include a single pair of a fixed contact and a movable contact, a relay may include multiple pairs of a fixed contact and a movable contact. Furthermore, an insulating film may be formed on the collecting electrodes to insulate the fixed contact and the movable contact from the collecting electrodes and to insulate the collecting electrodes from each other. In addition, electrodes such as mesh electrodes may be used as the collecting electrodes on an as-needed basis.

What is claimed is:

1. An electromagnetic relay comprising:

a fixed contact part including a fixed contact;

a movable contact part including a movable contact that faces the fixed contact;

an armature formed of a magnetic material, the armature being configured to bring the movable contact into or out of contact with the fixed contact;

an electromagnet configured to generate a magnetic field to move the armature;

a base holding the fixed contact part, the movable contact part, and the electromagnet; and a plurality of electrodes configured to generate an electric field between the electrodes, the electrodes facing each other without contacting each other, the electrodes being provided near at least one of the fixed contact and the movable contact and insulated from the fixed contact and the movable contact.

2. The electromagnetic relay as claimed in claim 1, wherein the electrodes are configured to generate the electric field greater than an electric field generated between the fixed contact and the movable contact.

3. The electromagnetic relay as claimed in claim 1, wherein the electrodes include a first electrode and a second electrode that face the fixed contact part and the movable contact part, respectively.

4. The electromagnetic relay as claimed in claim 3, wherein the first electrode and the second electrode are connected to the movable contact part and the fixed contact part, respectively, and a voltage is applied to the first electrode and the second electrode from the movable contact part and the fixed contact part, respectively.

5. The electromagnetic relay as claimed in claim 1, further comprising:

a cover surrounding a body of the electromagnetic relay, the body including the fixed contact part, the movable contact part, the armature, the electromagnet, and the base, and a recess is formed in one or both of the cover and the base near the electrodes.

6. The electromagnetic relay as claimed in claim 1, further comprising:

an adhesive substance provided on surfaces of the electrodes or near the electrodes.

7. The electromagnetic relay as claimed in claim 1, wherein the electrodes are provided close enough to the at least one of the fixed contact and the movable contact to attract and collect a charged foreign substance around the at least one of the fixed contact and the movable contact.

8. An electromagnetic relay, comprising:

a fixed contact and a movable contact that face each other;

an armature configured to bring the movable contact into or out of contact with the fixed contact;

an electromagnet configured to generate a magnetic field to move the armature; and a plurality of electrodes spaced from each other and from the fixed contact and the movable contact, the electrodes being configured to generate an electric field between the electrodes, the electrodes facing each other without contacting each other, the electrodes being provided near at least one of the fixed contact and the movable contact and insulated from the fixed contact and the movable contact.

* * * * *